United States Patent [19]

Andrus

[11] Patent Number: 4,872,094

[45] Date of Patent: Oct. 3, 1989

[54] WORK STATION ENVIRONMENTAL SYSTEM

[75] Inventor: William C. Andrus, Grand Rapids, Mich.

[73] Assignee: Design Council, Grand Rapids, Mich.

[21] Appl. No.: 255,660

[22] Filed: Oct. 11, 1988

[51] Int. Cl.[4] ..... F21Y 33/00

[52] U.S. Cl. ..... 362/96; 362/253; 362/282; 362/307; 362/373

[58] Field of Search ..... 362/96, 253, 345, 373, 362/307, 282, 277, 286, 804, 403

[56] References Cited

U.S. PATENT DOCUMENTS

| | | | |
|---|---|---|---|
| 2,201,153 | 5/1940 | Brown | 362/96 |
| 2,258,731 | 10/1941 | Blumenthal | 362/96 |
| 2,799,772 | 7/1957 | Stewart | 362/96 |
| 3,010,645 | 11/1961 | Mandelstam | 362/253 |
| 3,299,797 | 1/1967 | Dry | 362/96 |
| 3,936,176 | 2/1976 | Whited | 362/96 |
| 4,254,455 | 3/1981 | Neal, Jr. | 362/804 |
| 4,380,794 | 4/1983 | Lawson | 362/804 |
| 4,388,678 | 6/1983 | Turner | 362/296 |
| 4,428,032 | 1/1984 | Workman | 362/96 |
| 4,796,166 | 1/1989 | Greenberg | 362/96 |

FOREIGN PATENT DOCUMENTS

| | | | |
|---|---|---|---|
| 286265 | 10/1928 | United Kingdom | 362/804 |

*Primary Examiner*—Ira S. Lazarus
*Assistant Examiner*—Richard R. Cole
*Attorney, Agent, or Firm*—Price, Heneveld, Cooper DeWitt & Litton

[57] ABSTRACT

A compact system provides task lighting and ventilation assistance for a personal work station. The system includes a unidirectional light source and air moving fan positioned to coaxially, upwardly transmit a light beam and air stream. First and second deflection members are positioned along the axis in the path of the light and air. The lower deflection member transmits the light beam therethrough to the upper deflection member and deflects the air stream in an adjustable direction. The upper deflection member deflects the light beam in an independently adjustable direction.

19 Claims, 1 Drawing Sheet

WORK STATION ENVIRONMENTAL SYSTEM

BACKGROUND OF THE INVENTION

This invention relates to a system for modifying the environment in a personal work station area and in particular to a system for providing task lighting and air circulation for such a work station. While the invention is primarily intended for use with a computer work station, including a video display terminal, it may find application in other work station settings.

Computer work stations typically provide an environment that contributes to fatigue of the operator One of the most difficult environmental factors to regulate in a computer work station is task lighting. Lighting that may be appropriate for typical desk work is wholly inappropriate for a video display terminal (VDT) operator. Variations in the contrast between the VDT brightness and illumination of the reference copy materials creates eyestrain. Glare, which is undesirable in any environment, is especially fatiguing in the context of a VDT work station.

Characteristically, the conventional computer work station is provided in the form of a cubicle having walls extending, partially or fully, from the floor to the ceiling. Such cubicles tend to be installed subsequent to the design of the larger room in which they are placed and the lighting in the ceiling grid is usually not matched to the location of the work station cubicle. Thus, contrast variations between the VDT and the reference copy materials, as well as shadows that are cast across both the VDT and the reference copy materials, are aggravated by the use of paneled cubicles.

An additional difficulty created by cubicle work stations is the interference caused by the paneled walls, with the natural air circulation in the larger room in which the cubicle is positioned. The paneled walls block the natural air flow and tend to trap heat generated by the computer system. The environment of the computer work station is thus further degraded by inadequate air circulation and a buildup of heat.

While attempts have been made to improve these factors tending to degrade the work station environment, most such attempts have had serious drawbacks. Various task lighting devices have been proposed. Most such devices, however, take up premium work space within the human reach zone of the work station. Those devices that may be remotely located, tend to create fatigue-generating glare because of compromises resulting from the remote location. While attempts have been made to provide a light source that allows adjustment of the direction of the light, and/or the intensity of the light, one variable is usually dependent upon the other. The usual result is that either light intensity is improper or glare is produced. Additionally, the proposed prior art devices have not addressed the problem of inadequate air circulation and a buildup of heat, generated by the computer equipment, in the work station environment. Accordingly, it is the object of the present invention to provide a solution to such environmental problems present in the personal work station.

SUMMARY OF THE INVENTION

The above difficulties are overcome by the present invention which provides an apparatus for modifying the environment in a work area. The apparatus includes means for transmitting energy in a first medium, such as visible light, in a given direction and second means for transmitting energy in a second medium, such as air, in the same direction. First deflection means is provided, spaced from the first energy transmission means in the direction of energy transmission, and capable of deflecting the first medium. The invention further provides second deflecting means, spaced from the second energy transmission means and positioned between the first energy transmission means and the first deflecting means. The second deflecting means is capable of deflecting the second medium and passing the first medium. In this manner, both energy transmission means and both deflecting means may be aligned along an axis, with the first medium passing through the second deflecting means to be deflected by the first deflecting means and the second medium being deflected by the second deflecting means. Thus, independent control of the first and second mediums is provided in a compact unit that may be positioned remotely of the human reach zone in a work station.

These and other related objects, advantages and features of this invention will become apparent upon review of the following specification in conjunction with the drawings.

DESCRIPTION OF THE PREFERRED EMBODIMENT

Figure 1:
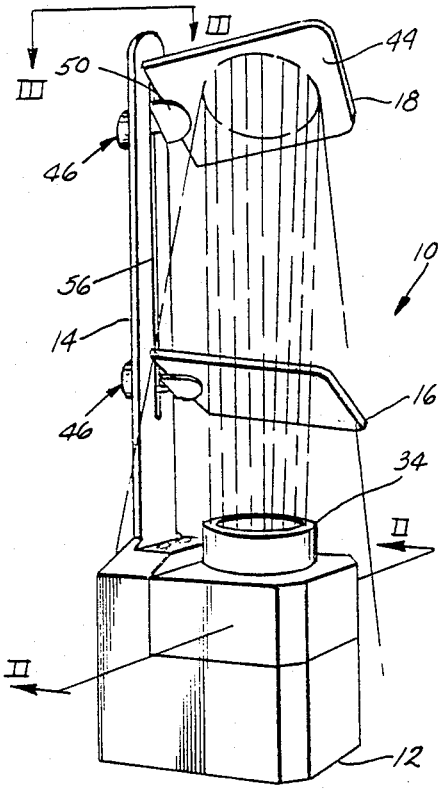
FIG. 1 is a perspective view of a work station environmental system according to the invention.

Referring now specifically to the drawings and the illustrative embodiments depicted therein, a work station environmental system, generally shown at 10, includes as base unit 12, a support member 14 extending upwardly from base 12 and first and second deflecting members 16 and 18, respectively, attached to support member 14.

Base unit 12 includes a unidirectional light source 20 and an air moving fan 22 positioned within a housing 24. Housing 24 includes a recessed flange portion 26 on a top wall thereof. Flange 26 is circular in configuration and includes edge means for defining a circular opening 28 in the housing. A donut-shaped screen member 30 is supported in opening 28 by flange 26 and includes a central opening 32 having the diameter of light source 20 and which is aligned with the light source. A cylindrically-shaped light shade 34 surrounds light source 20 and is supported by screen member 30.

Light source 20, in a preferred embodiment, includes a quartz bulb 36 surrounded by a reflector 38 for directing the light generated by bulb 36 unidirectionally along a vertical axis designated A. The bulb and reflector are commercially available as a combined unit manufactured by the General Electric Company under Model Q42MR16/VNSP (EZY). Such a unit is powered by a 12 volt DC power supply 40. The voltage provided from power supply 40 to bulb 36 may be varied by a rheostat (not shown) in order to provide intensity adjustment for the light source. Air flow fan 22 is, in a preferred embodiment, a 27 cubic foot per minute high-speed fan that is commercially available and sold by the Radio Shack Corporation under Catalog No. 273-243A. In the preferred embodiment, air flow fan 22 is energized by a 120 volt AC power source, such as conventional house power. It is to be understood that light source 20 may alternatively be configured to be supplied by a 120 volt AC power source and air moving fan 22 may alternatively be energized by 12 volt DC power supply 40 through a speed-adjusting rheostate. A connector 42 attached to a non-rotating portion of fan 22 provides electrical connections to bulb 36 from power source 40. Air moving fan 22 is positioned within housing 24 in a manner to unidirectionally move a stream of air along axis A, i.e., coaxially with the unidirectional light beam generated by light source 20.

Accordingly, energy is transmitted vertically along axis A in two media: by radiation in the visible light spectrum from light source 20 and pneumatically by air flow directed through screen member 30 from fan 22. The vertically ascending light beam and air stream encounter first deflecting member 16, which is configured to transmit the light beam therethrough into contact with second deflecting member 18. Deflecting member 16 is sufficiently imperforate, however, to deflect a significant amount of the air stream away from the surface of deflecting member 16 at the angle of incidence of the air stream. Second member 18 includes a light reflecting surface 44, such that the light beam transmitted through member 16 is deflected at the angle of incidence from member 18 by surface 44.

In a preferred embodiment, first deflecting member 16 is a transparent planar plexiglass member mounted to support member 14 by adjustable mounting means 46. In this preferred embodiment, second deflecting member 18 is a planar plexiglass member having a mirrored surface 44 for deflecting the light beam and is attached to support member 14 by another adjustable mounting means 46.

Figure 3:
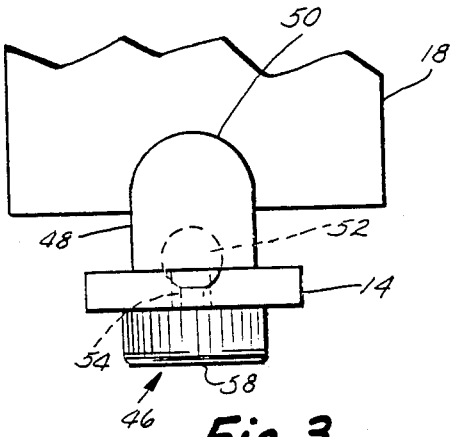
FIG. 3 is an enlarged partial plan view taken along the lines III—III in FIG. 1.
Figure 2:
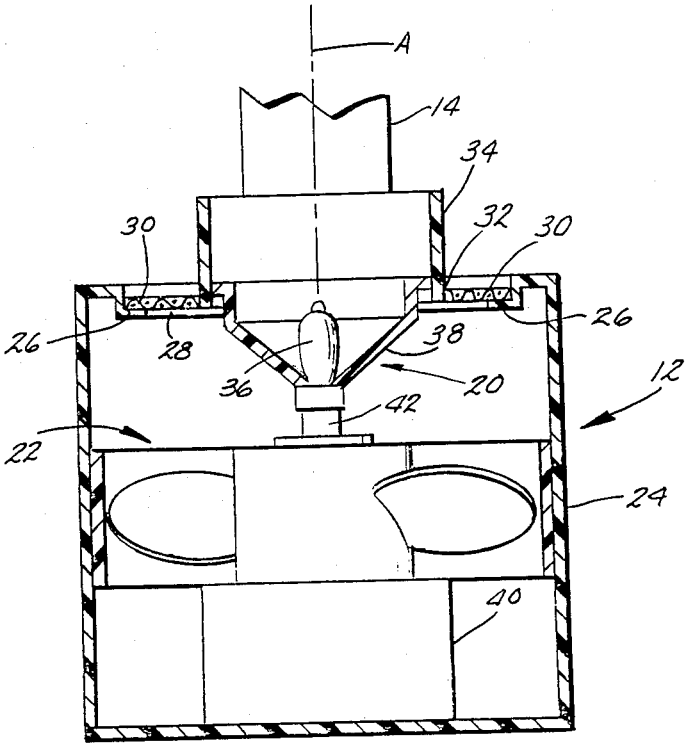
FIG. 2 is a sectional view taken along the lines II—II in FIG. 1.

Mounting means 46 includes a forked bracket member 48 having a pair of fingers 50 (only one of which is illustrated) spaced-apart the thickness of the respective deflecting member (FIG. 3). A ball 52 is engaged with a mating socket within bracket member 48 and includes a threaded shaft 54 extending through a slotted opening 56 in support member 14 and threadably engaged by an adjusting knob 58.

With adjusting knob 58 loosened, shaft 54, and hence the respective deflection member, may be longitudinally positioned along support member 14. Additionally, the resulting clearance between ball 52 and its mating socket (not shown) provides means for adjusting the angular orientation of the respective deflecting member with respect to axis A. The deflecting member may be angularly adjusted in mutually perpendicular planes extending laterally and longitudinally through system 10. This allows the deflecting members 16 and 18 to be independently pivoted relatively upwardly or downwardly and laterally from side-to-side with respect to support member 14. By adjusting deflecting member 16, the air stream exiting base unit 12 may be substantially deflected laterally at a desired angle to one side or the other, or towards the forward portion of the unit, away from support member 14 or any combination of directions. Likewise, by adjusting the angular orientation of second deflecting member 18, the light beam reflected therefrom may be directed laterally at a desired angle to one side or the other or may be directed forwardly or a combination of directions. By adjusting the longitudinal positions of deflecting members 16 and 18 along support member 14, the size of the light spot produced on the work surface by the light beam may be increased or decreased and the relative density of the air stream increased or decreased. While longitudinal adjustment of the deflecting members 16 and 18 may additionally provide a degree of adjustment of the intensity of the light and air reaching the desired targets, in the preferred embodiment the intensities are controlled by varying the voltage from power source 40 to the respective light source 20 and air moving fan 22.

The present invention is thus seen to provide a compact unit that provides a unique solution to two difficult environmental problems. The unit is not only compact and requires little support room, but may be positioned remotely of the human reach zone. The ability to independently direct, focus and adjust the intensity of the light source enhances the ability of the invention to reduce the production of unwanted glare and to produce a balance in contrast between the VDT screen and the work copy.

Changes and modifications in the specifically described embodiments can be carried out without departing from the principles of the invention which is intended to be limited only by the scope of the appended claims, as interpreted according to the principles of patent law, including the doctrine of equivalents.

The embodiments of the invention in which an exclusive property or privilege is claimed are defined as follows.

1. An apparatus for modifying the environment in a work area comprising:

unidirectional light source means for directing light in a beam along a given axis;

air moving means for moving air in a stream along said axis; and adjustable separating means for separating said air stream from said light beam and for directing said air stream and said light beam away from said axis, said adjustable separating means defining selectably adjustable directing means for allowing a user to direct said air stream and said light beam in separate selectable directions away from said axis.

2. An apparatus for modifying the environment in a work area comprising:

first energy transmission means positioned on a given axis for transmitting visible light in a given direction;

second energy transmission means positioned on said axis for transmitting air in said direction;

light deflecting means positioned on said axis for deflecting visible light away from said axis, said first deflecting means being spaced from said first energy transmission means in said direction;

air reflecting means positioned on said axis for reflecting air from said axis, said air reflecting means being spaced from said second energy transmission means and positioned between said first energy transmission means and said light deflecting means, said air reflecting means being a light transmitting member that is sufficiently imperforate to be capable of reflecting air flowing along said axis and passing light, whereby visible light can pass through said air reflecting means and be deflected by said light deflecting means and air can be reflected by said air reflecting means.

3. The apparatus in claim 2 in which said light deflecting means and said air reflecting means are angularly adjustable with respect to said axis.

4. The apparatus in claim 3 in which said light deflecting means and said air reflecting means are longitudinally adjustable along said axis.

5. The apparatus in claim 2 in which said light deflecting means and said air reflecting means are longitudinally adjustable along said axis.

6. An apparatus for modifying the environment in a work area comprising:

first energy transmission means positioned on a given axis for transmitting visible light in a given direction;

second energy transmission means positioned on said axis for transmitting air in said direction;

first deflecting means positioned on said axis comprising a light reflecting surface spaced from said first energy transmission means in said direction and capable of deflecting visible light;

second deflecting means positioned on said axis comprising a light transmitting member that is sufficiently imperforate to deflect a significant volume of air flowing along said axis, said second deflecting means being spaced from said second energy transmission means and positioned between said first energy transmission means and said first deflecting means, said second deflecting means being capable of deflecting air and passing visible light, whereby said visible light can pass through said second deflecting means and be deflected by said first deflecting means and air can be deflected by said second deflecting means;

wherein each of said deflecting means is angularly adjustable with respect to said axis; and wherein each of said deflecting means is longitudinally adjustable along said axis.

7. An apparatus for modifying the environment in a work area comprising:

lamp means for generating visible light and directing the light along a given axis in a given direction;

fan means for generating air movement and directing said air movement along said axis in said direction;

light deflecting means spaced from said lamp means in said direction and positioned on said axis for deflecting light that contacts said deflecting means away therefrom;

air deflecting means spaced from said fan means and positioned on said axis between said lamp means and said light deflecting means, said air deflecting means for deflecting air that contacts said air deflecting means away therefrom and transmitting light that contacts said air deflecting means therethrough.

8. An apparatus for modifying the environment in a work area comprising:

lamp means for generating visible light and directing the light along a given axis;

fan means for generating air movement and directing said air movement along said axis;

light reflecting means spaced from said lamp means and positioned on said axis for reflecting light that contacts said reflecting means away therefrom, said light reflecting means being angularly adjustable with respect to said axis;

air deflecting means spaced from said fan means and positioned on said axis between said lamp means and said light reflecting means, said air deflecting means for deflecting air that contacts said air deflecting means away therefrom and transmitting light that contacts said air deflecting means therethrough.

9. The apparatus in claim 8 which said air deflecting means is angularly adjustable with respect to said axis.

10. The apparatus in claim 9 in which said light reflecting means is longitudinally adjustable along said axis.

11. The apparatus in claim 10 in which said air deflecting means is longitudinally adjustable along said axis.

12. The apparatus in claim 9 in which said air deflecting means is longitudinally adjustable along said axis.

13. An apparatus for modifying the environment in a work area comprising:

a compact base unit including a housing, a light source in said housing positioned to direct a light beam away from said base unit along a given axis and an air fan in said housing positioned to direct a stream of air away from said base unit along said axis;

elongated mounting means extending from said base unit parallel said axis;

a first member positioned on said axis spaced from said base by said mounting means, said member including a generally planar light reflecting surface positioned to be contacted by light from said light source, whereby said member will reflect light in a direction away from said axis;

a second member positioned on said axis by said mounting means between said base and said first member, said second member including a generally planar air reflecting surface positioned to be contacted by air from said fan, said second member being substantially transparent, whereby said second member will reflect air in a direction away from said axis and transmit light to said first member.

14. The apparatus in claim 13 in which said first member is made from planar plexiglass and said light reflecting surface is a mirrored surface on said plexiglass member.

15. The apparatus in claim 14 in which said second member is made from planar transparent plexiglass 16. The apparatus in claim 13 in which said mounting means includes means for adjusting the longitudinal position of said members along said axis.

17. The apparatus in claim 16 in which said mounting means further includes means for adjusting the angular position of said members with respect to said axis.

18. The apparatus in claim 13 in which said mounting means includes means for adjusting the angular position of said members with respect to said axis.

19. The apparatus in claim 13 further including a shade for said light source extending from said base along said axis.

* * * * *

UNITED STATES PATENT AND TRADEMARK OFFICE

CERTIFICATE OF CORRECTION

PATENT NO. : 4,872,094

DATED : October 3, 1989

INVENTOR(S) : WILLIAM C. ANDRUS

It is certified that error appears in the above-identified patent and that said Letters Patent is hereby corrected as shown below:

Column 1, line 13:

After "operator" insert --.--

Column 3, line 6:

"rheostate" should be --rheostat--

Column 6, line 10:

After "claim 8" insert --in--

Column 6, line 50:

After "plexiglass" insert --.--.

Signed and Sealed this

Fourteenth Day of May, 1991

*Attest:*

HARRY F. MANBECK, JR.

*Attesting Officer*

*Commissioner of Patents and Trademarks*